US005662041A

United States Patent [19]

Kleist

[11] Patent Number: 5,662,041

[45] Date of Patent: Sep. 2, 1997

[54] DOCTOR BLADES FOR PAD PRINTING MACHINES AND MACHINES INCLUDING SAME

[75] Inventor: Egon Kleist, Hanover Park, Ill.

[73] Assignee: Trans Tech America, Inc., Carol Stream, Ill.

[21] Appl. No.: 556,501

[22] Filed: Nov. 13, 1995

Related U.S. Application Data

[63] Continuation-in-part of Ser. No. 449,817, May 24, 1995, Pat. No. 5,476,040.

[51] Int. Cl.[6] ..... B41F 31/00

[52] U.S. Cl. ..... 101/163; 101/41; 101/169; 101/364

[58] Field of Search ..... 101/163, 167, 101/169, 170, 35, 41, 44, 327, 379, 368, 492

[56] References Cited

U.S. PATENT DOCUMENTS

| | | | |
|---|---|---|---|
| 4,060,031 | 11/1977 | Philipp | 101/163 |
| 4,314,504 | 2/1982 | Combeau | 101/163 |
| 4,508,032 | 4/1985 | Philipp | 101/163 |
| 4,557,195 | 12/1985 | Phlipp | 101/163 |
| 4,615,266 | 10/1986 | DeRoche et al. | 101/163 |
| 4,621,386 | 11/1986 | Hill | 101/169 |
| 4,709,632 | 12/1987 | Samuels et al. | 101/163 |
| 4,779,531 | 10/1988 | Ueno et al. | 101/163 |
| 4,905,594 | 3/1990 | Phillip et al. | 101/163 |
| 5,003,872 | 4/1991 | Dalferth | 101/163 |
| 5,222,433 | 6/1993 | Philipp | 101/163 |
| 5,237,922 | 8/1993 | Ho | 101/333 |
| 5,272,972 | 12/1993 | Tobita | 101/163 |
| 5,272,973 | 12/1993 | Chojnacki | 101/163 |
| 5,320,037 | 6/1994 | Harris | 101/163 |
| 5,363,761 | 11/1994 | Galassi | 101/163 |
| 5,383,398 | 1/1995 | Binnen | 101/163 |
| 5,392,706 | 2/1995 | Drew, II et al. | 101/163 |
| 5,408,926 | 4/1995 | Alder | 101/170 |
| 5,410,961 | 5/1995 | Denicola | 101/363 |
| 5,469,786 | 11/1995 | Harris | 101/163 |
| 5,537,921 | 7/1996 | Adner et al. | 101/35 |

OTHER PUBLICATIONS

Igus inc. catalog; cover page and pp. 1–14 and 69–80, dated Jan. 1995.

Material Safety Data Sheet of Victrex USA Inc., dated Jan. 27, 1994.

*Primary Examiner*—Eugene H. Eickholt
*Attorney, Agent, or Firm*—Leydig, Voit & Mayer, Ltd.

[57] ABSTRACT

The doctor portion of the ink cup of a pad printing machine is formed of a polymeric composite which has high compressive strength and high resistance to chemicals, notably to printing inks. The polymeric doctoring portion is tapered and defines a narrow distal end surface which circumscribes the open end of the cup for doctoring engagement with an opposed plastic gravure surface. The doctoring portion may be a separate ring element suitably mounted at the open end of the cup body or it may be a unitary part of the cup. In a preferred embodiment, this doctoring portion is a ring formed of a polymer composite reinforced by carbon fibers and which is permeated by lubricant particles or granules of graphite.

34 Claims, 4 Drawing Sheets

DOCTOR BLADES FOR PAD PRINTING MACHINES AND MACHINES INCLUDING SAME

This is a continuation-in-part of my application Ser. No. 08/449,817 filed May 24, 1995, now U.S. Pat. No. 5,476,040, the disclosure of which is incorporated herein by reference.

FIELD OF THE INVENTION

The present invention relates generally to pad printing machines, and more particularly, to improved doctor rings of ink cups in such printing machines.

BACKGROUND OF THE INVENTION

Sealed ink cup pad printing machines comprise an ink cup which is supported in inverted fashion with a sealing and "doctoring" end surface thereof in abutment with a printing block or "cliche" that is mounted in reciprocating fashion for transferring ink in a predetermined pattern to a printing pad. The ink cup includes an annular surface, which may be an integral part of the cup or, alternatively, a separate ring, that serves as a sliding seal between the ink cup and the cliche and as a doctor blade or "knife" for ensuring that only the engraved portions of the cliche carry ink to the printing pad pick-up site. U.S. Pat. Nos. 4,557,195 and 4,905,594 disclose examples of prior such machines and their disclosures are incorporated herein by this reference.

To ensure quality printing with pad printers, it is important that the annular doctor blade of the ink cup reliably scrape or Wipe from the cliche plate all ink that is not within the engraving recesses. Consistently obtaining the clean wiping action has presented problems. To obtain and maintain a sealing and wiping action, doctor elements typically have been formed of a very hard material, such as carbide, ceramic, high speed steel, or other hard metal, and have been finished to a very accurate planar surface, as by lapping. For example, the aforenoted U.S. Pat. No. 4,557,195 describes the use of hard materials for forming the end contact surfaces of the ink cups, at least in those areas which serve a wiping function. A further suggestion is made therein that it may be possible to use elastic parts made of metal or plastic for the side portions of rectangular cup end surfaces which extend parallel to the direction of displacement and do not have a wiping function, but merely serve the function of sealing aprons in a non-etched area.

Many cliches are made of metal, particularly for high volume reproduction of the same image. However, cliches which have a plastic gravure surface, e.g. of a photosensitive polymer material, have gained wide usage because generally they are much less expensive to produce and to engrave than the cliches which use a metal gravure surface. The plastic gravure surfaces may be provided by using a basic support plate or block, as of metal, with a gravure surface formed by a layer, laminate or coating of a photosensitive polymer, or may constitute an entire plate or block of such a polymer material. However, the plastic gravure surfaces have tended to wear much more rapidly than the metal or metal-surfaced cliches. For this reason, the cliches with plastic gravure surfaces have been used primarily for relatively short production runs.

OBJECTS AND SUMMARY OF THE INVENTION

It is an object of this invention to extend the useful life of non-metallic gravure surfaces in pad printing machines.

It is a further object of this invention to provide for increased useful life of cliches which use gravure surfaces of conventional photosensitive plastic materials in such machines.

It is a more specific object of this invention to reduce the wear rate on cliches which have non-metallic gravure surfaces and particularly plastic surfaces.

It is another object of this invention to provide ink cups with improved doctor blade surfaces in pad printing machines.

It is a further object to provide improved pad printing machines which include improved doctor blades.

It is a further object of the present invention to provide improved doctor blades for and in pad printing machines, such as those disclosed in my said application Ser. No. 08/449,817.

It is another object of this invention to provide improved methods of printing with cliches which have plastic gravure surfaces.

It has been found that the useful life of plastic gravure surfaces in pad printing machines may be greatly extended, while preserving excellent doctoring results, by forming the doctor ring portion of the abutting ink cups from plastic materials. Such a doctoring portion preferably is formed of a polymeric composite which has high compressive strength and high resistance to chemicals, notably to printing inks. The polymeric doctoring portion should define a narrow distal end surface which circumscribes the open end of the cup for compressive sliding, sealing and doctoring engagement with an opposed plastic gravure surface. The doctoring portion may be a separate ring element suitably mounted at the open end of the cup body or it may be a unitary part of the cup. It has been found that some wear of the distal end occurs, and that the reliability of obtaining clean doctoring of the gravure surface decreases significantly in current machines when the tip width increases beyond about 0.04 inches. It is beneficial to form this contact portion with a narrow tapered cross section, such as with an initial tip width on the order of 0.03 inches and tapering to approximately 0.05 inches within the range of anticipated wear.

A specific material which presently is preferred for forming such a doctoring portion is a polymer composite of a polyetherketone reinforced by carbon fibers and which is permeated by lubricant particles or granules of graphite in the form of a graphite impregnated resin. One such material presently on the commercial market is the "iglide T 500" material which currently is marketed by igus, inc., of East Providence, R.I.

Figure 1:
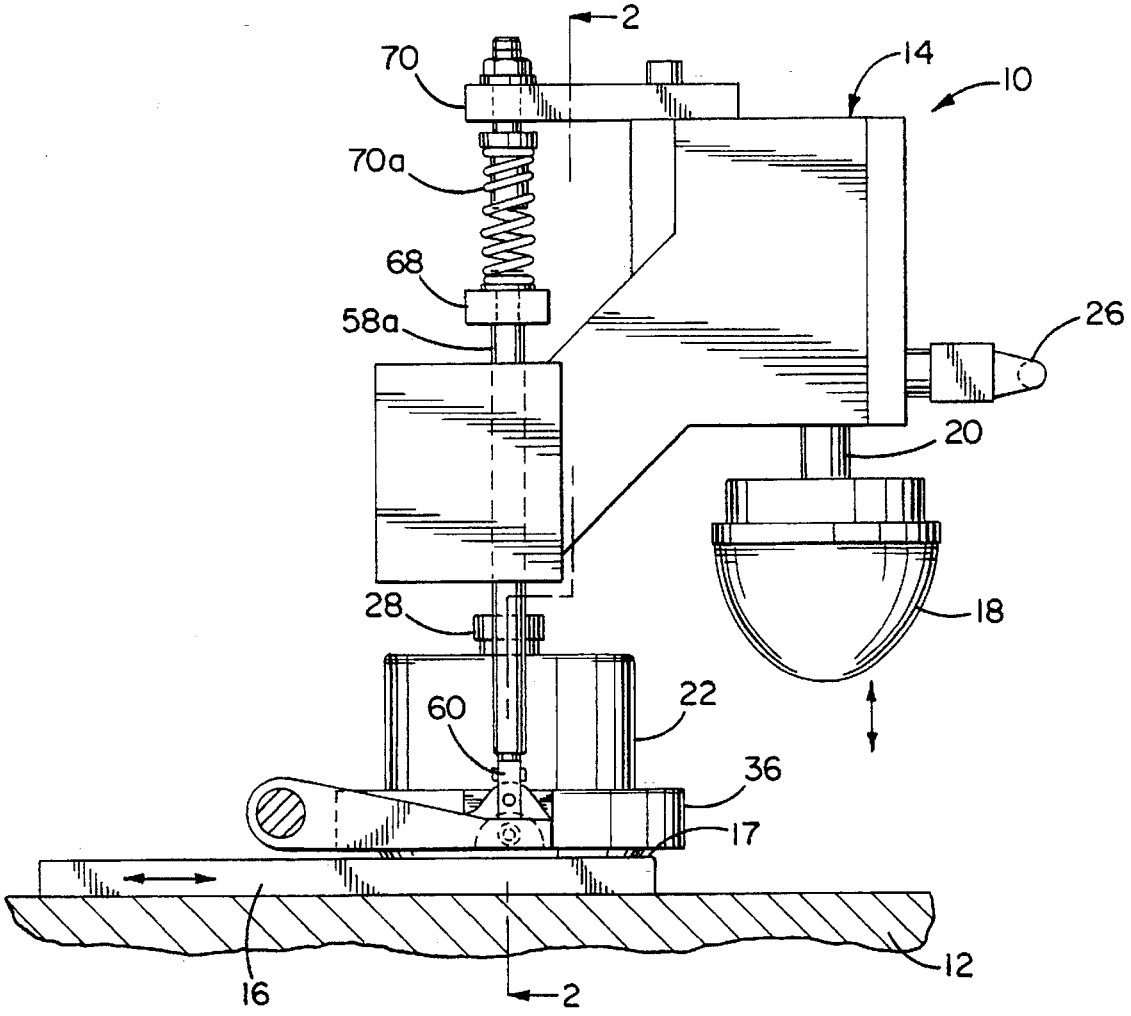
FIG. 1 is a side view of the printer section of a pad printing machine employing teachings of this invention.
Figure 2:
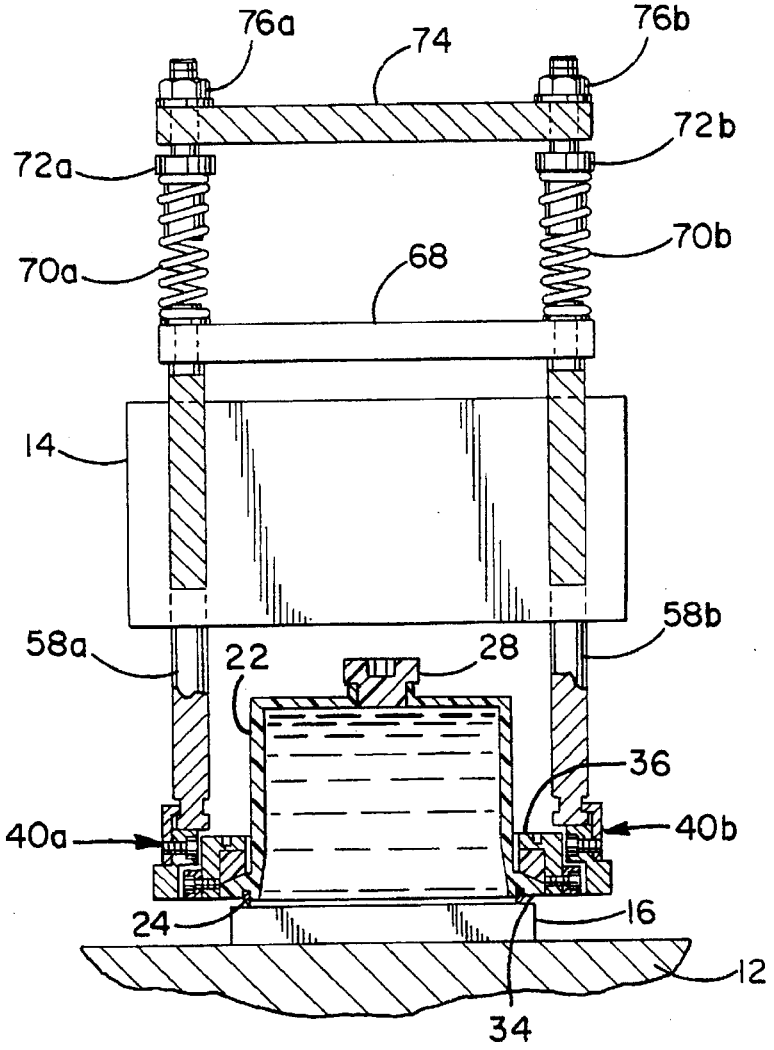
FIG. 2 is a vertical view, partially in section, taken generally along the broken line 2—2 of FIG. 1.

While the invention is susceptible to various modifications and alternative constructions, a preferred embodiment has been shown in the drawings and will be described in detail. It will be understood, however, that there is no intention to limit the invention to the specific embodiment, but on the contrary the intention is to cover all modifications, alternative constructions and equivalents falling within the spirit and scope of the invention.

DESCRIPTION OF THE PREFERRED EMBODIMENT

Figure 3:
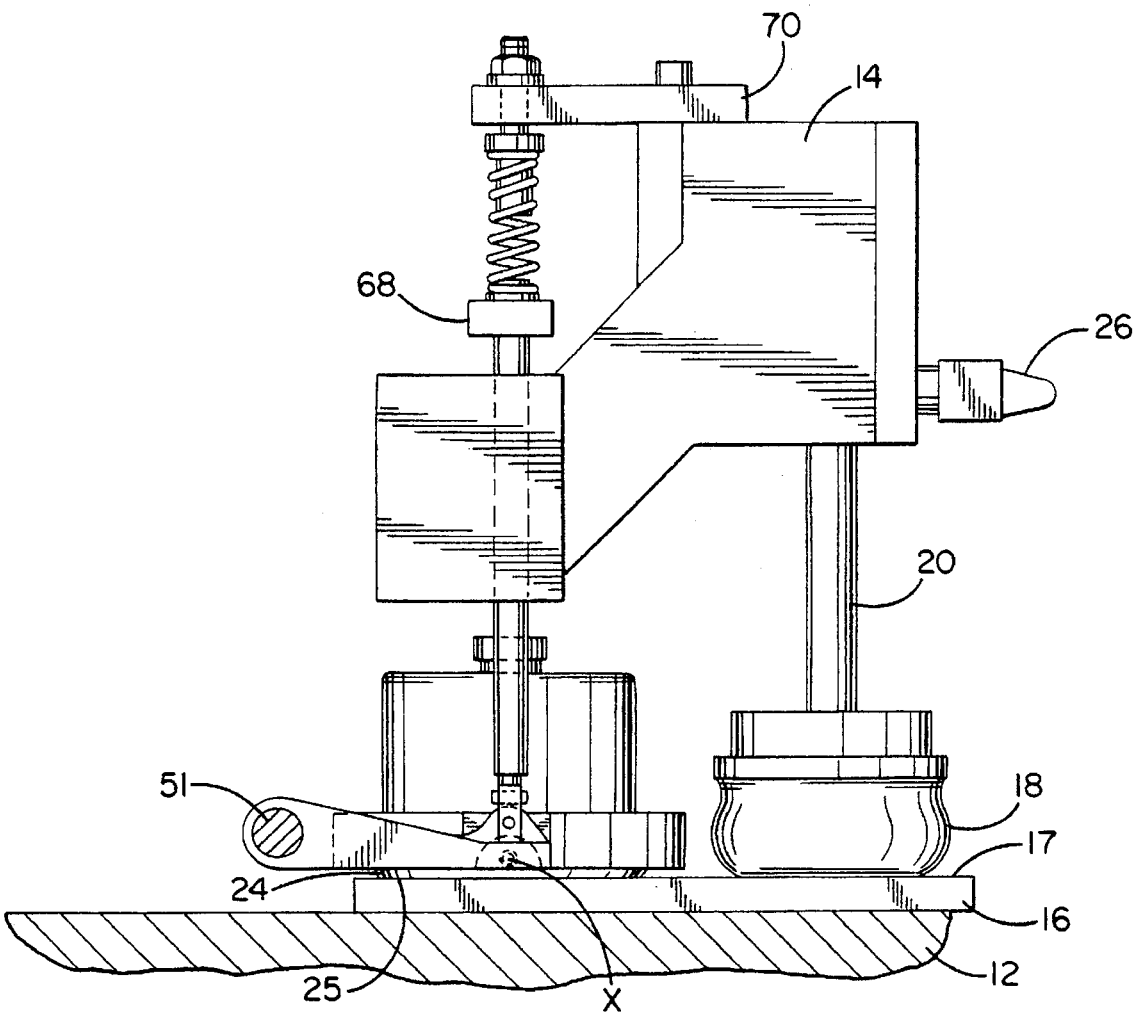
FIG. 3 is a view of the apparatus of FIG. 1 with the cliche and the printing pad advanced to their impression transferring positions.

The drawings illustrate the ink holding and transfer components of a pad type printing machine 10. The machine includes a support frame of which the illustrated portions include a base 12 and an upper frame portion 14 both of which are components of an appropriate frame structure for such machines, as is known in this art. A flat gravure plate 16 is suitably mounted on the plate bed for reciprocation between a retracted inking position as in FIG. 1 and an extended transfer position as seen in FIG. 3. This plate, also commonly known as a cliche, may be of any suitable material, typically being metal, plastic or a combination thereof and normally being photo engraved on its upper gravure surface 17 with the text, logo or other pattern which is to be printed by the operation of the machine 10. In the machine 10 the gravure surface 17 is the upper surface of a non-metallic, preferably plastic layer 16A which carries the engraved image in a known manner; see FIG. 4. Preferably, this is a thin layer of a photoreactive polymer which is applied to the top surface of a printing block body 16B of another material, such as by affixation of a sheet or coating 16A of the photosensitive polymer to a base printing block 16B formed of metal or the like. However, the gravure surface 17 also may be an integral part of a printing block formed of an appropriate polymer material.

Suitable polymer gravure materials and commercial products for providing the plastic gravure surface 17 are known. For example, they include plates and laminates made of the various so called photosensitive or photoreactive polymers currently available in the market, such as various polyamide photopolymer materials. Further, they may be of the water wash types, such as the "nyloprint" and "nylograv" plates available from BASF Lacke+Farben AG of Stuttgart, Germany, or alcohol wash types, such as of the "ST-52" material available from the same company.

A transfer pad 18 of appropriate configuration is mounted on a support rod 20 for suitable vertical reciprocating motion. With the cliche 16 extended, the pad 18 is pressed against the engraved area of the cliche as in FIG. 3 to receive the ink pattern therefrom and then is retracted upward. While the cliche subsequently is retracted as in FIG. 1 for re-inking, the pad 18 is advanced against a recipient object to transfer the ink pattern thereto, in a known manner by any appropriate coordinated driving mechanism.

An ink cup 22 is mounted over the cliche to serve as a supply reservoir for the printing ink. The cup has an open bottom for free access of the ink to the upper surface 17 of the cliche and has a doctor blade or "knife" ring portion 24 around its open lower end. This blade 24 must be maintained in continuous and constant contact with the adjacent surface 17 of the cliche 16 at all times to form a seal for retaining the ink supply in the cup 22 and to scrape the surface 17 clean of all ink thereon as the cliche is advanced from the loading position of FIG. 1 to the transfer position of FIG. 3, except only for the ink in the depressions engraved or otherwise formed in the upper surface 17 to define the print pattern. The blade portion 24 may be part of the. Cup itself or a separate element suitably attached to the lower end of the cup. In either event, the doctor blade presents a very narrow distal end surface 25 against the clicke and is subject to continual wiping action against the cliche as the cliche is reciprocated. The blade ring 24 is formed of a plastic which has high compressive strength, thereby providing a firm lower doctoring edge portion of plastic. As discussed further below, a self-lubricating material presently is preferred.

It is very important that the contact end surface 25 of the knife ring and the upper surface 17 of the cliche be accurately formed and maintained in suitable compressive abutting engagement with one another throughout the length of the knife blade, i.e. throughout the circumference of the ring. Slight deviations of either surface from the other, on the order of a few microns, or even variations in the compressive force therebetween along different portions of the circumference of the ring, can cause leakage of the ink, or leave a film of ink in undesired areas of the exposed portions of the cliche (sometimes referred to as "fogging") and/or cause scratches or other undesirable wear patterns on the cliche and/or the doctor ring which can adversely affect the useful life of the relatively expensive cliches and rings. Thus, it is highly desirable that intimate but uniform pressure contact be maintained between the ring and the gravure surface of the cliche.

An adjustment handle 26 is provided at the front of the apparatus to adjust the effective length of the support rod A removable filler plug 28 is provided in the upper end of the ink cup. The cup 22 also includes an annular flange 34, such as is typically provided adjacent the lower open end of such cups.

As discussed in greater detail in the aforementioned patent application Ser. No. 08/449,847, the illustrated hold down mechanism for maintaining the cup in position with its doctor blade 24 in desirable continuous engagement with the cliche 16 includes: A thrust collar 36 which fits in superposed relationship over the flange 34; the collar 36 is pivotably mounted at diametrically opposite sides by a pair of interconnection mechanisms 40*a* and 40*b* for pivotal movement about an axis "X" which is parallel to the surface 17 and perpendicular to the reciprocating path of the cliche; and, the bearing structure for applying external downward forces to the thrust collar 36 and thus to the cup 22 is of a design to assure that these forces are applied to the collar at points spaced forwardly and rearwardly of the transverse pivot axis X (see FIG. 3) and not directly on the pivot axis, to provide a restraining or stiffening action which resists fore-and-aft tilting tendencies of the cup as the cliche reciprocates.

Down-pressure forces are applied to the cup support components by a pair of pressure rods 58*a*, 58*b* which are disposed in parallel, Upright arrangement thereover. Slight vertical relative movements are allowed between the two pressure rods and hence between the two sides of the collar 36 to allow tilting adjustment of the collar and hence of the cup 22 transversely of the center longitudinal horizontal axis which is generally parallel to the direction of reciprocation of the cliche and orthogonal to the aforementioned X axis. To this end the pressure rods 58*a* and 58*b* are mounted for vertical movement in the machine frame portion 14. A pressure plate 68 is mounted on the upper ends of these two rods 58*a*, 58*b*. A pair of compression springs 70*a*, 70*b* engage the upper ends of the respective rods 58*a*, 58*b* and have their upper ends confined by respective adjustable tension screw mechanisms 72*a*, 72*b* which are supported in an upper spring plate 74 that is affixed to the machine frame 14. The compressive force applied by each spring 70*a*, 70*b* can be adjusted, such as by threaded adjustment of the respective mounting nuts shown at 76*a*, 76*b*.

In the preferred embodiment, the cup 22 is formed of a hard plastic, such as the UHMW PE product TIVAR 1000®. However, the benefits of this invention are realizable with ink cups formed of other materials, such as aluminum, steel or other metals or other plastics, or of other designs.

Figure 4:
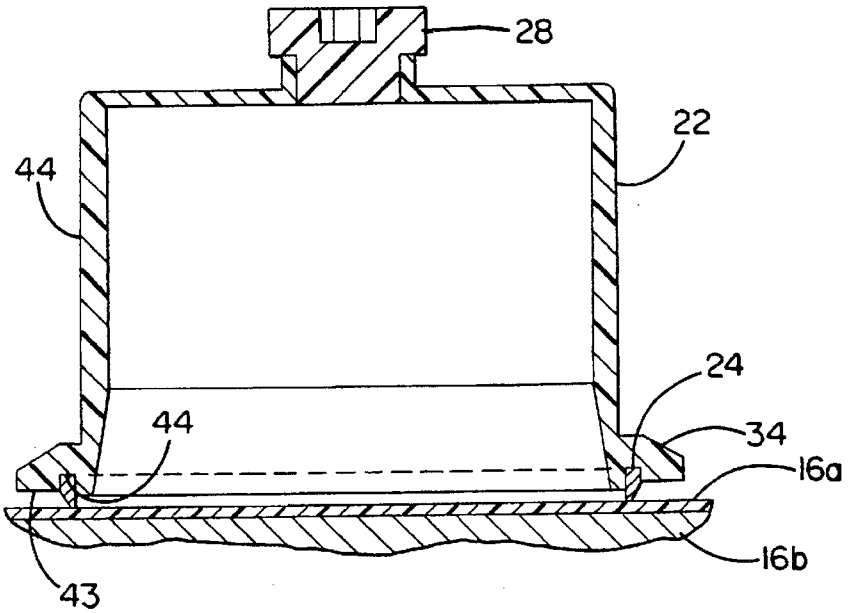
FIG. 4 is an enlarged diametrical cross sectional view of an ink cup and abutting cliche as in FIG. 2.
Figure 5:
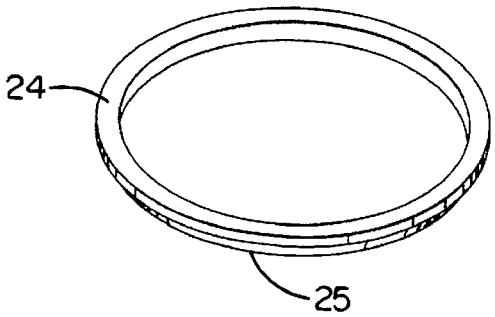
FIG. 5 is an enlarged perspective view of a doctor ring as in FIG. 4.
Figure 6:
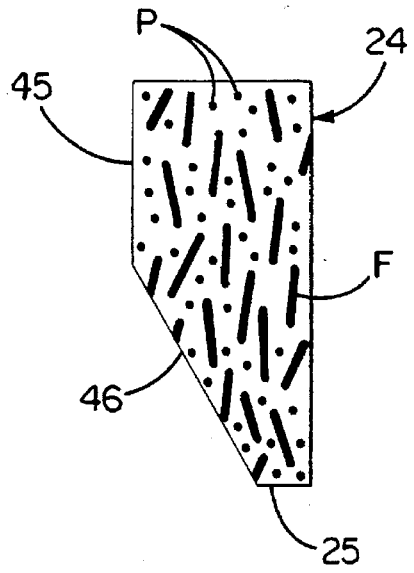
FIG. 6 is a further enlarged cross-sectional detail view of the doctor ring of FIG. 5.

Turning now particularly to FIGS. 4–6, the doctor ring portion 24 of the cup 22 is a separate continuous ring which is force-fit into a groove 42 in the distal end face 43 of the cup body 44. The ring includes a generally rectangular base portion 45 which fits into the groove 42 and a tapered end portion 46 which narrows from the base portion to a narrow distal edge or end surface 25 that constitutes the doctoring surface. The ring 24, when installed in the cup body 44 as in FIG. 4, defines and circumscribes the open end of the ink cup 22. The ring 24 is formed of a polymeric composite which has high compressive strength, e.g., greater then about 15,000 psi at temperatures below about 300° F., and up to about 21,750 psi below 100° F., i.e. at ambient room temperatures. The polymeric composite also has high chemical resistance to printing inks and preferably a self-lubricating property, while also having good wear resistance. That is, the distal doctoring end surface is slow to wear away while serving the doctoring function against an abutting and reciprocating plastic gravure surface. It appears that the provision of a narrow end surface is important to obtaining clean consistent wiping or "doctoring" to remove from the surface 17 all ink except that which is in the engraved grooves which define the desired print pattern, with the down-forces normally applied to the cups 22 in the described types of machines.

Figure 7:
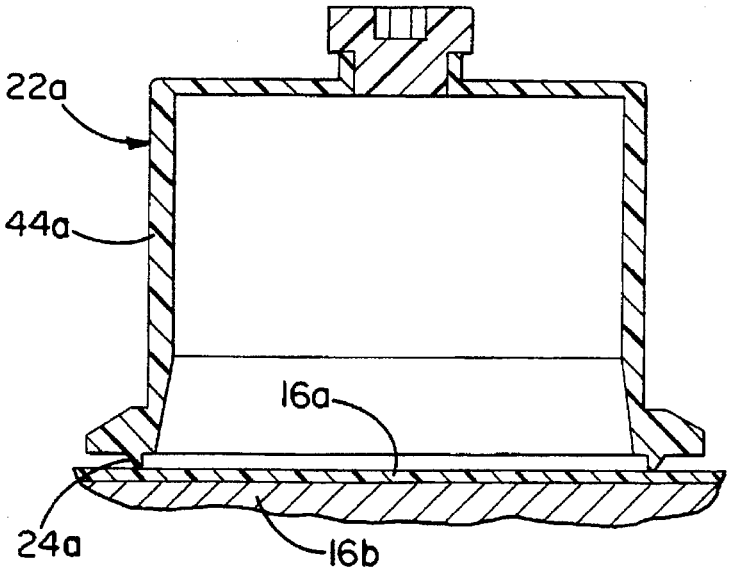
FIG. 7 is a view similar to FIG. 4 illustrating another embodiment employing teachings of this invention, namely in an ink cup wherein the doctor ring portion is formed integral with the main body of the cup.

FIG. 7 illustrates an alternative embodiment of an ink cup 22A in which a doctoring ring portion 24A is integral with the cup body 44A. Such a cup may be provided by molding the cup and ring as one unitary structure or by machining to its final form from a molded or cast blank of appropriate materials as described herein with respect to the ring 24. Alternatively, an integral unit 24A could be fabricated by fusion molding or "welding", using such materials for the doctor ring portion and a different but compatible material for the cup body portion.

In the presently preferred embodiment, the ring 24 is fabricated of a high performance composite which is permeated by solid lubricant particles. A specific example is a ring machined from a cylinder made of the aforenoted "iglide T 500" material. That material is understood to consist of a polymeric composite of a VICTREX® PEEK product "450CA30" available from Victrex USA, Inc., of West Chester, Pa., comprising 70% of a polyaryletherketone (polyetheretherketone) and 30% carbon fibers, and which is permeated by a solid lubricant, namely graphite particles or powder. The composite is illustrated schematically in FIG. 6, wherein F indicates the fibers and P indicates the lubricant particles.

As one particular example, circular rings 24 have been machined from cylinders of the aforenoted material. Such rings had an outside diameter of 65 mm and an inside diameter of 60 mm, resulting in a ring width (measured radially of the ring) of 2.5 mm across the base portion 45, a total axial depth of the ring of about 6 mm, a depth of the rectangular base portion 45 of about 2 mm, a depth of the tapered portion 46 of about 4 mm, and an initial radial width Of the end surface 25 of about 0.05 mm. These rings have functioned very well until the width of the contact surface increased to the point that "fogging" began to appear on the gravure surface, apparently due to hydroplaning rather than clean wiping engagement by the end surface. With these particular rings, operated with downpressure forces typical for such machines, such fogging tended to occur when the end surface 25 wore to a radial width of about 0.04 inches, i.e. about 1 mm.

The initial sealing and wiping action of doctoring portions as described herein improve during initial use, apparently due to a self-lapping action against the abutting and reciprocating plastic gravure surface. It has been found that rotating the cup 22 periodically to vary its rotational position relative to the direction of reciprocation of the cliche, e.g., following each few thousand print cycles, helps assure uniform wear of the doctoring portion and the gravure surface while maintaining the sealing and clean wiping action on the gravure surface.

Rings as described herein have provided consistent clean doctoring operation of plastic gravure surfaces over greatly extended functional lives of the plastic images, i.e., providing substantial increases in the number of useful print cycles obtained with each plastic gravure plate as compared to use Hard metal doctor rings on gravure plates made of the same plastic materials.

From the foregoing it can be seen that apparatus and related methods have been provided which accomplish the aforenoted objects of this invention.

It will be understood that other variations and modifications and the substitution of equivalent mechanisms, can be effected within the spirit and scope of this invention, particularly in light of the foregoing teachings. It is contemplated by the following claims to cover any such modifications and other embodiments that incorporate those features which constitute the essential features of the invention within the true spirit and scope of the following claims.

What is claimed is:

1. An ink cup for a pad printing machine, said ink cup having an open end and comprising a doctoring portion that defines said open end, said doctoring portion having a narrow distal end surface which circumscribes said open end and is of a configuration for sliding, sealing and doctoring engagement with an opposed gravure surface, said doctoring portion being formed of a polymer.

2. The invention as in claim 1 wherein said doctoring portion has a narrow distal end surface.

3. The invention as in claim 2 wherein said distal end surface is less than about 0.05 inches in width.

4. The invention as in claim 2 wherein said distal end surface is no greater than about 0.04 inches in width.

5. The invention as in claim 1 wherein said doctoring portion is of a tapered cross-section configuration which narrows in a distal direction.

6. The invention as in claim 5 wherein said distal end surface is no greater than about 0.04 inches in width.

7. The invention as in claim 1 wherein said polymer has a high compressive strength.

8. The invention as in claim 7 wherein said doctoring portion is formed of a self-lubricating polymer composition.

9. The invention as in claim 8 wherein said doctoring portion is formed of a fiber-reinforced polymer which contains a lubricant.

10. The invention as in claim 8 wherein said doctoring portion is a composite formed of polyaryletherketone, carbon fibers and a solid lubricant.

11. The invention as in claim 10 wherein said polyaryletherketone is polyetheretherketone.

12. The invention as in claim 10 wherein said lubricant is graphite.

13. The invention as in claim 7 wherein said doctoring portion is formed of a thermoplastic composite of about 70% polyetheretherketone and about 30% carbon fibers by volume and is permeated by particles of graphite.

14. The invention as in claim 1 wherein said cup includes a body portion having an open end and said doctor portion is a separate element mounted on said body at said open end thereof.

15. The invention as in claim 1 wherein said cup and said doctoring portion are a unitary component.

16. The invention as in claim 1 wherein said cup is of a cylindrical configuration with said open end at one axial end thereof.

17. A doctor ring mounted on the open end of an ink cup of a pad printing machine, said doctor ring being of a continuous closed loop configuration and including a distal end surface which is continuous around said ring and is of a configuration for sliding, sealing and doctoring engagement with an opposed gravure surface, at least the portion of said ring which forms said distal and surface being formed of a polymer material.

18. The invention as in claim 17 wherein said portion is of a tapered cross-section configuration which narrows toward said distal end surface.

19. The invention as in claim 18 wherein said portion has a narrow distal end surface.

20. The invention as in claim 19 wherein said ring is of a unitary homogeneous construction and formed of a polymeric composition which has a high compressive strength and is self lubricating.

21. The invention as in claim 20 wherein said ring is formed of a polymer which contains carbon fibers.

22. The invention as in claim 19 wherein said ring is a composite formed of a polyaryletherketone, carbon fibers and graphite.

23. A pad printing machine comprising a cliche having an upwardly exposed plastic gravure surface, an ink cup disposed over said cliche, said ink cup having an open end and including a doctoring portion formed of a polymer that defines said open end, said doctoring portion having a narrow distal end surface that circumscribes said open end and is in sliding, sealing and doctoring contact with said plastic gravure surface, and one of said cliche and said cup being reciprocate along a predetermined path relative to the other for successively inking an image engraved in said gravure surface.

24. The invention as in claim 23 wherein said cliche is reciprocative along a predetermined path and said ink cup is fixed relative to said path.

25. The invention as in claim 23 wherein said cliche includes a body plate and a photopolymer layer attached to said body plate and forming said gravure surface.

26. The invention as in claim 23 wherein said cliche is formed of a photopolymer.

27. A method of printing comprising providing a printing block having a polymeric surface with a gravure image in at least a portion thereof, mounting said printing block with said surface in a generally horizontal plane, providing an ink cup having an open end with a doctoring portion which defines said open end, forming said doctoring portion of a polymeric material shaped with a narrow distal end surface thereof which circumscribes said open end and is of a configuration for sliding, sealing and doctoring engagement with said plastic surface of said printing block, positioning said ink cup over said printing block with said plastic end surface of said ink cup in abutting engagement with said polymeric surface of said printing block, and repetitively sliding at least one of said printing block and said ink cup generally horizontally relative to the other while maintaining said end surface of said ink cup in compressive doctoring contact with said surface of said printing block and thereby successively depositing ink from said cup in said image and exposing the resulting inked image, and transferring the successive inked images to objects to be printed with said image.

28. The invention as in claim 27 wherein said printing block is reciprocated along a predetermined generally horizontal path and said ink cup is held in a fixed position relative to said path.

29. The invention as in claim 27 wherein said printing block is formed of a body plate and a photoreactive polymer layer attached to said body plate and forming said surface of said printing block.

30. The invention as in claim 27 wherein said printing block is formed of a photoreactive polymer,.

31. The invention as in claim 27 wherein said doctoring portion is formed as a unitary component using a polymeric composition which has a high compressive strength and is self-lubricating.

32. The invention as in claim 31 said doctoring portion is formed of a fiber-reinforced polymeric.

33. The invention as in claim 31 wherein said doctoring portion is formed of polyetheretherketone which contains carbon fibers and graphite granules.

34. A doctor ring adapted for mounting on the open end of an ink cup of a pad printing machine, said doctor ring being of a continuous closed loop configuration and including a distal end surface which is continuous around said ring and is of a configuration for sliding, sealing and doctoring engagement with an opposed gravure surface, at least the portion of said ring which forms said distal end surface being formed of a polymer material, said distal end surface being less than about 0.05 inches in width, and said portion having a tapered cross-section configuration which narrows toward said distal end surface.

* * * * *